United States Patent [19]

Norkus

[11] Patent Number: 4,870,901

[45] Date of Patent: Oct. 3, 1989

[54] APPARATUS FOR ATTACHING A PRINTING BLANKET TO A PRINTING CYLINDER

[75] Inventor: Christopher P. Norkus, Arlington, Mass.

[73] Assignee: W. R. Grace & Co.-Conn., Lexington, Mass.

[21] Appl. No.: 280,628

[22] Filed: Dec. 6, 1988

Related U.S. Application Data

[63] Continuation of Ser. No. 191,839, May 6, 1988, which is a continuation of Ser. No. 51,556, May 18, 1987, abandoned, which is a continuation of Ser. No. 817,959, Jan. 13, 1986, abandoned.

[51] Int. Cl.[4] ..... B41F 1/28

[52] U.S. Cl. ..... 101/415.1

[58] Field of Search ..... 101/415.1, 378, 409

[56] References Cited

FOREIGN PATENT DOCUMENTS 37754 10/1981 European Pat. Off. ..... 101/415.1

607498 9/1948 United Kingdom ..... 101/415.1

*Primary Examiner*—Eugene H. Eickholt

*Attorney, Agent, or Firm*—John Dana Hubbard; William L. Baker

[57] ABSTRACT

A lock-up mechanism for holding printing blankets to printing cylinders in rotary presses, which eliminates the problem of blanket pullout. The lock-up mechanism includes a substantially planar surface on a reel rod, running from the inner edge of the axial groove to a point on the reel rod circumference on the opposite side of the reel rod center. The substantially planar surface forms an angle with the inner edge of the reel rod groove and the surface of from about 85° to about 97°, preferably about 90°. The configuration eliminates blanket pullout by redirecting the forces applied to the blanket to a direction where the forces do not tend to pull the blanket out of the groove. The lock-up mechanism can be used in any printing cylinder, but most preferably in narrow gap type cylinders.

9 Claims, 4 Drawing Sheets

APPARATUS FOR ATTACHING A PRINTING BLANKET TO A PRINTING CYLINDER

This invention relates to a lock-up mechanism for mounting a printing blanket onto a surface of a printing cylinder of rotary type printing presses.

This is a continuation of application Ser. No. 07/191,839, filed May 6, 1988 which is a continuation of Ser. No. 07/051,556, filed on May 18, 1987 (now abandoned), which is a continuation of Ser. No. 817,959, filed on Jan. 13, 1986 (now abandoned).

BACKGROUND OF THE INVENTION

Various means have been used by the printing industry to secure printing blankets to the outer surfaces of printing cylinders. A typical means is that in which the cylinder has a gap formed in its outer surface which extends inwardly to form a pocket or recess in which one or more reel rods are rotatably mounted. These reel rods generally have an axial groove in their surfaces for receiving the ends of the printing blanket. The blanket ends are reinforced with a strip of metal known as blanket bars, which stiffen the blanket end, making it easier to insert into the reel, rod grooves. After insertion of the ends into the grooves of the reel rods, the reel rods are rotated in a direction away from the gap so as to pull the blanket into the pocket and tighten it over the surface of the printing cylinder. See for example, U.S. Pat. Nos. 4,426,931 showing a dual reel rod system and 4,510,868 showing a single reel rod system.

These lock-up means work adequately, however, they do suffer several drawbacks, one of which is termed "blanket pullout." Blanket pullout refers to the tendency of the blanket ends to pull out of the groove of the reel rods, causing the blanket to separate from the printing cylinder. The result of blanket pullout is a damaged blanket which often must be replaced; substantial down time of the press while the blanket is inspected and reattached or replaced; and the loss of the printed material affected by the loose blanket.

This phenomenon has become more problematical in the "narrow gap" technology which is now being developed. Narrow gap refers to the cencept of reducing the size of the gap in the cylinder. Narrow gap cylinders generally have a gap width of less than 0.210 inches and ideally, a width of approximately 0.180 inches. Gap width on a conventional cylinder is generally about 0.250 inches. Narrowing the gap reduces the incidence of "bounce" during printing. Bounce is a vibration caused by the impact of the edges of the gap against the adjoining printing roll. Bounce affects printing quality, causing streaks and runs, and machine life, causing an increase in the rate of wear on the blankets and cylinders. Using a narrow gap also increases the number of available print lines for a given cylinder size. Because of these benefits, narrow gap technology has become increasingly more popular.

As the gaps have narrowed, the thickness of the printing bars have correspondingly decreased. These thinner bars are more difficult to hold in the reel rods and exhibit a significantly greater occurance of blanket pullout than blankets with conventional bars. Various devices have been designed or suggested to cure the problem of blanket pullout in narrow gap cylinders.

One such suggestion has been to reduce the width of the groove in the reel rod to form a tighter hold on the blanket end. This suggestion has not yet been proven or accepted in practice and would require replacement of the entire reel rod and would make insertion of the blanket end into groove more difficult.

Another attempt is that shown in U.S. Pat. No. 4,261,262 where one or more support rods are placed between the two reel rods to lock the blanket ends in the grooves of the reel rods and prevent their pulling out. This requires a redesigning or new purchase of the press cylinder to accommodate the additional support rods. Further, the support rods interfere with the easy insertion and removal of the blankets from the reel rods.

The present invention overcomes these difficulties and provides an easy, effective and inexpensive means for preventing blanket pullout, especially in narrow gap cylinders.

OBJECTS OF THE INVENTION

It is an object of the present invention to provide a device for securing a blanket to a printing cylinder of a rotary printing machine which is easy and inexpensive to manufacture and use and which affords uniform or even and reliable securing of the blanket to the cylinder and which prevents blanket pullout.

It is another object of the invention to provide a device which is easily interchanged with preexisting reel rods and which provides easy and reliable securing of a blanket while preventing blanket pullout.

Another object is to provide a printing cylinder having a gap in its outer cylindrical surface, which contains one or more rotatable reel rods having an axial groove into which blanket ends are placed for securement, the reel rods having a substantially planar surface adjacent the edge of the groove over which the blanket portion extending out of the groove forms an angle which fully seats the blanket ends in the groove and prevents the blanket ends from pulling out.

A further object is to provide an improved reel rod for use in a lock-up mechanism in which the reel rod has a substantially planar surface extending from the inner edge of its axial groove to the outer circumferential edge of the reel rod by which the substantially planar surface forms an angle with a blanket inserted in the groove for securement such that the blanket is fully seated into the groove and prevented from pulling out of the groove.

It is an object of the present invention to provide a substantially planar surface on a reel rod adjacent the axial groove, which surface forms an angle from about 85° to about 97° with the edge of the groove.

Another object is to provide a printing cylinder lock-up mechanism which ensures the blanket will not pull out by eliminating all components of blanket force which tend to pull the blanket out.

A further object is to provide a simple method for modifying a printing cylinder lock-up mechanism so as to prevent blanket pullout.

In the present invention it is an object to provide a simple, easy and effective means for preventing blanket pullout in conventional and narrow gap printing cylinders.

An object is to provide a lock-up mechanism for securing both ends of a printing blanket to a printing cylinder by having a gap formed in the outer cylinder surface of the cylinder, the gap expanding inwardly and radially to form a recess in which a reel rod is located, the reel rod being rotatably mounted in the recess so as to be offcenter from the cylinder gap and having an axial groove in an outer portion of the reel rod which is aligned with the cylinder gap and having a substantially planar surface running from the inner edge of the groove and substantially perpendicular to the groove, across to the opposite edge of the reel rod so that when the blanket ends are inserted in the groove and the reel rod is rotated to tighten the blanket to the cylinder, the blanket portion adjacent the groove meets and substantially conforms to the substantially planar surface such that the portion adjacent the groove and the inner edge of the groove form a substantially perpendicular angle which holds the blanket portion fully into the groove and prevents the blanket from pulling out.

A further object is to provide a simple means by which existing reel rods may be modified to prevent blanket pullout.

Another object is to provide a substantially planar surface on a reel rod adjacent its axial groove so that when the reel rod containing a blanket end is in its locked position, the blanket portion adjacent the substantially planar surface has intimate contact with and conforms to that surface.

A further object of the present invention is to provide a lock-up means which prevents blanket pullout and allows the use of thin, flexible blanket bars instead of thick and rigid bars.

An object of the present invention is to provide a lock-up means for securely fastening sheet materials having a rotating spindle means with an axial groove for holding the ends of the sheet and a substantially planar means forming an angle with the axial groove so as to hold the sheet in place.

IN THE DRAWINGS

DETAILED DESCRIPTION AND PREFERRED EMBODIMENTS

Figure 1:
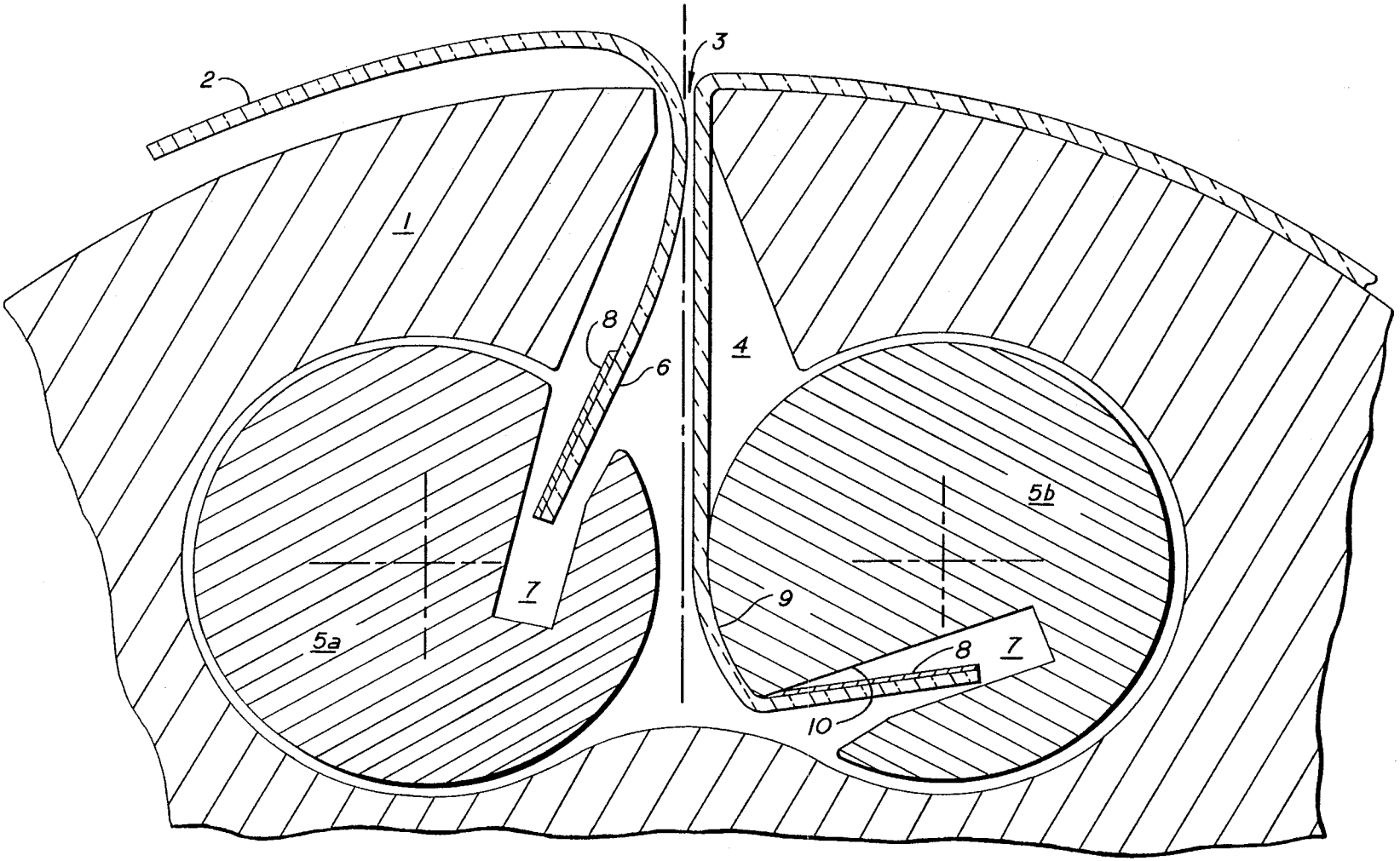
FIG. 1 PRIOR ART
FIG. 1 shows a cross-sectional view of a printing cylinder lock-up mechanism used in the printing industry today.

FIG. 1 shows a conventional printing cylinder 1 having a printing blanket 2 extending around its outer cylindrical surface. The gap 3 which may be either of a conventional or narrow type extends radially inward from the surface of the cylinder to form a recess 4. In the recess are two reel rods 5*a*, 5*b*. The reel rods are rotatably mounted in the recess 4 in a manner well known in the art and not shown, as not being a necessary part of the present invention.

Each reel rod, 5*a* and *b*, has an axial groove 7 which is spaced off center of the reel rod, but in alignment with the gap 3. The groove 7 extends along the entire length of the reel rod and therefore across the width of the cylinder.

In FIG. 1, an end 6 of the printing blanket is shown as it is being inserted through the gap into the longitudinal groove 7 of the reel rod 5*a*. The blanket bar is a reinforcement used to stiffen the blanket end. The bar makes the insertion of the blanket end into the reel rod groove easier and it also tends to help keep the end in the groove.

Reel rod 5*b* of FIG. 1 is shown in the locked or engaged position. The reel rod is shown as having been rotated in a counter-clockwise direction so that the blanket 2 has been tightened to the cylinder 1. The blanket end 6 with its bar 8 is shown as being braced against the side of the axial groove of the reel rod. The blanket also is shown as extending out of the groove and across the circumferential surface 9 of the reel rod. The blanket portion in the area of the curved surface 9 forms an obtuse angle with the inner edge of the groove 10. The angle can vary depending upon the location of the groove to the center line of the reel rod. As the groove is located further away from the center of the reel rod, the angle becomes greater. Generally the grooves of the reel rods are located as far away from the center of the reel rod as practicable to maximize its alignment with the cylinder gap. In the prior art presses discussed herein, the angle is generally greater than 112°.

In practice, the blanket ends are inserted into the reel rods which are then rotated to a position similar to that shown by reel rod 5*b*. This draws the blanket 2 tight against the cylinder 1 which is now ready for use.

Figure 2:
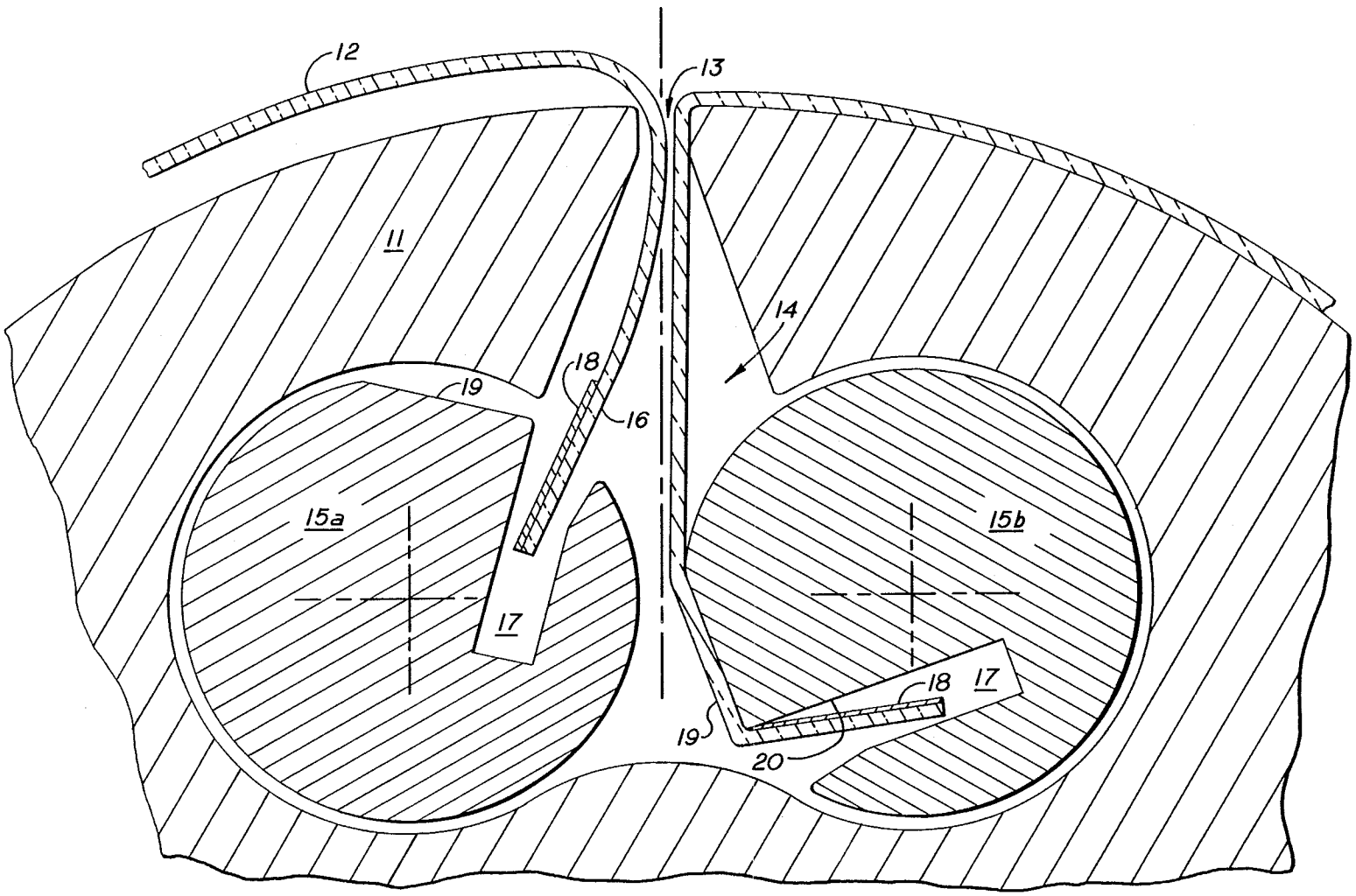
FIG. 2 shows cross-sectional view of a preferred embodiment of the present invention.

A preferred embodiment of the present invention is shown in FIG. 2.

The printing cylinder 11, blanket 12, cylinder gap 13 and recess 14 are all similar to that described in FIG. 1.

The surface 19 of the reel rods 15*a*, 15*b*, nearest the inner edge 20 of the axial groove 17 is substantially flattened when compared to the edge 9 of FIG. 1.

This substantially planar surface 19 insures that the blanket end 16 with its bar 18 is kept in the axial groove when the reel rod is rotated to its locked or engaged position, as shown by reel rod 15*b*.

The operation of the present invention is similar to that described for the conventional system of FIG. 1. The reel rods 15*a* and b are turned to align their longitudinal grooves 17 with gap 13, the blanket ends 16, each having a blanket bar 18, are inserted through the gap 13 and into the reel rod grooves 17. The reel rods are then rotated in a direction which draws the blanket 12 into the cylinder recess 14 and tightens the blanket to the outer surface of the cylinder 11. As the reel rods 15*a* and b are rotated, the blanket meets and conforms to the substantially planar surface 19, which directs the forces perpendicular to the groove edge 20 to prevent the blanket bar from pulling out when in the engaged position.

The angle between the substantially planar surface 19 and the inner edge 20 of the reel rod groove 17 can be from about 85° to about 97°, while the preferred angle is about 90°. An angle greater than about 97° suffers from blanket pullout as frequently as a conventional reel rod with an angle of at least 112°. An acute angle of less than about 85° is not desirable, as it introduces an added stress concentration factor in the blanket which decreases the breaking strength of the blanket to an extent where the blanket breaks upon locking.

An angle of 90° is therefore preferred as it optimizes the prevention of blanket pullout while minimizing the reduction in blanket strength.

Figure 4:
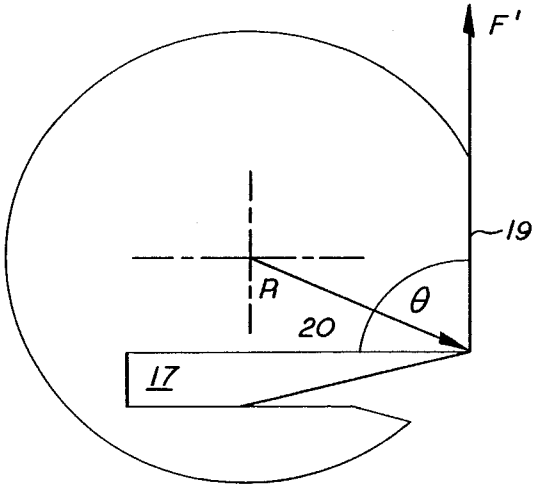
FIG. 4 shows a cross-section of a preferred embodiment of the present invention in the lock-up position with the various forces acting upon it and the blanket.
Figure 3:
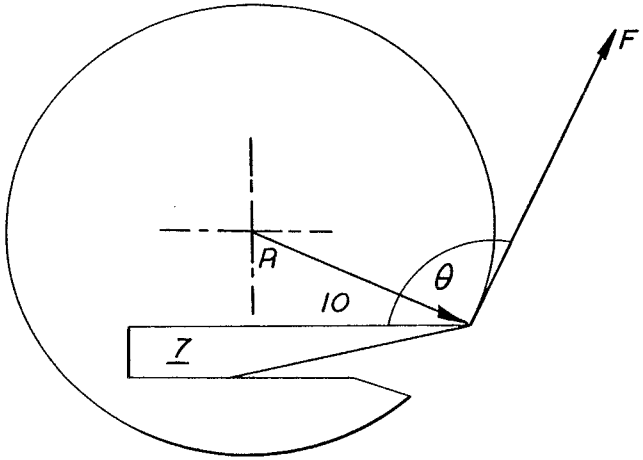
FIG. 3 PRIOR ART
FIG. 3 shows a cross-section of a conventional reel rod in the lock-up position with the various forces acting upon it and the blanket.

It is believed that blanket pullout is caused by the larger angle (greater than 112°) imposed upon the blanket end by the curvature of the reel rod surface adjacent the inner edge of the axial groove as shown in a conventional printing cylinder of FIG. 1. Applicant believes that the use of a substantially planar surface (19) adjacent to the inner edge (20) of the groove (17) eliminates blanket pullout by redirecting the forces in the blanket end in a direction which inhibits pullout. FIGS. 3 and 4 and the following discussion on those Figures are submitted as a non-binding illustration of the cause of blanket pullout and Applicant's cure for that problem.

FIG. 3 shows a conventional reel rod of FIG. 1 with the various forces and variables acting upon it and the blanket during lock-up. It can be seen that the blanket force F is tangent to the circumference of the reel rod and perpendicular to the radius, R. Since the inner edge 10 of the groove is not along the radius but is offset by a distance, A, the blanket force F departs the surface 10 at an angle, 0, which is at least 112°. This force F acts upon the blanket end in groove 7 and during normal printing operations tends to pull the blanket end out of the groove. It can also be clearly seen that the further the reel rod is rotated away from the gap, the greater the blanket force becomes, and the greater the tendency for blanket pullout becomes.

In FIG. 4 is an isolated reel rod, a preferred embodiment of the present invention having the same parameters as in FIG. 3. The preferred embodiment of FIG. 4 shows the angle of 90° between the substantially planar surface 19 and the inner edge 20 of the groove. It can be seen that the blanket force F′ is parallel to the substantially planar surface 19 of the reel rod, and perpendicular to the inner edge of the groove 20. The blanket force F′, being perpendicular, does not tend to pull the blanket end out of the groove.

When the angle is less than about 97° the blanket force F′ will not pull the blanket end out of the groove. Further, when the angle is less than 90°, the blanket force F′ actually forces the blanket end into the groove rather than just maintaining the blanket end in place as occurs from 90° to about 97°.

While Applicant believes the above explanation fully discloses the cause of and cure for blanket pullout, Applicant does not intend to be bound by the illustration presented above. It is possible that other explanations could be found to show why blanket pullout occurs and why Applicant's invention eliminates the problem.

Figure 5:
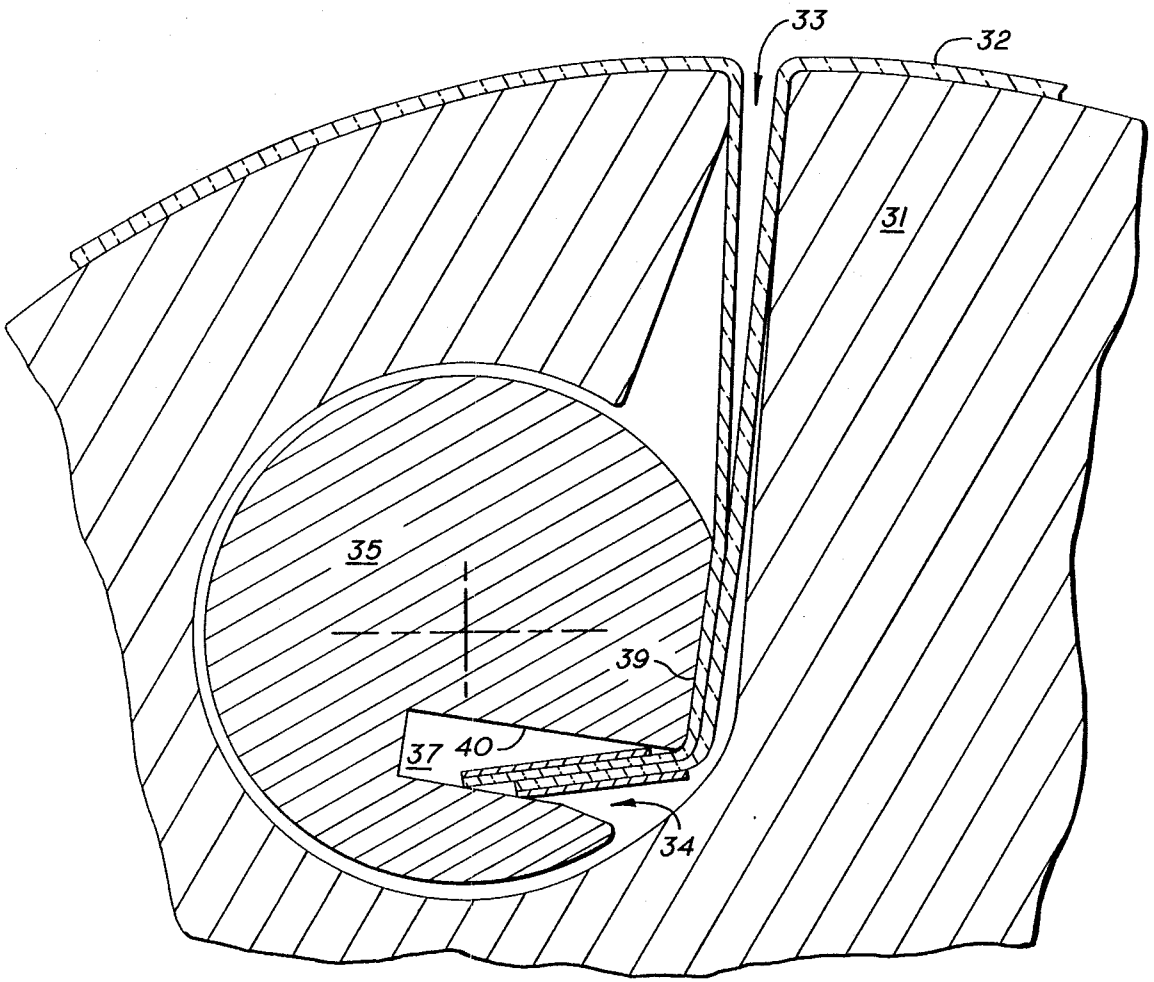
FIG. 5 shows another preferred embodiment of the present invention in cross-section.

Another embodiment of the present invention is shown in FIG. 5, in which a single reel rod-up mechanism is used.

The cylinder 21 has a blanket 22 extending through the cylinder gap 23 and into the recess 24 where a single reel rod 25 is rotatably mounted offcenter of the gap so that its longitudinal groove 27 is aligned with the gap in its non-engaged or unlocked position. The single reel rod lock-up mechanism operates in the same way and achieves the same result as the two reel rod system of FIG. 2 discussed previously. The single reel rod system may be as shown or set up in mirror image on the other side of the gap or in any manner conventional in the printing art so long as the substantially planar surface 29 forms an angle from about 85° to about 97° with the inner edge of the groove 30.

The present invention may be formed by milling or otherwise forming a substantially planar surface on each reel rod from the inner edge of the groove across to the outer circumferential surface of the reel rod. The amount taken off of the reel rod should be sufficient to form a substantially planar surface over which the blanket may extend, while at the same time, it should not be so deep or extensive as to hinder retention or insertion of the blanket end in the groove. Preferably, the substantially planar surface should extend from the inner edge of the groove which is on the circumference of the reel rod to a point on the circumference on the other side of the center line of the reel rod that is parallel to the inner edge of the groove. An important factor in determining the location of the substantially planar surface is that the blanket should never be forced in a direction where the blanket force F or F′ can cause blanket pullout. The actual configuration depends upon the angle chosen and the location and width of the groove desired in each application. The length of the substantially planar surface should be sufficiently long as to ensure that the proper angle between the inner groove and the surface is achieved and to allow the blanket which conforms to that surface to achieve a similar angle as it exits the reel rod groove. A non-limiting example consists of a reel rod having a diameter of 1.5 inches, and a substantially planar surface of approximately 0.6 inches in length. Existing reel rods may be modified to incorporate this invention or new reel rods having the substantially planar surface may be used.

Another advantage of the present invention is its ability to use thinner and more flexible blanket bars than the reel rods now in operation, especially in the narrow gap technology.

In conventional printing blankets, the bars are typically quite thick, rigid and strong. The bars serve two purposes; they allow for easy insertion into the lockup mechanism by providing a straight, solid edge to be pushed down into the reel rod groove and they help, to some extent, in counting the blanket force, F, described in FIG. 3. The bars by their rigidity and strength butt up against the outer edge of the reel rod groove to counter blanket pullout, but they do not insure against blanket pullout completely.

With the advent of narrow cylinder gap technology, blanket bars have been made out of increasingly thinner materials so as to fit easily into the narrower cylinder gaps. This has rendered the bars more susceptible to bending or kinking, making insertion and removal more difficult and reducing the bar's ability to counter the blanket force which causes blanket pullout. Higher strength alloys and exotic materials have been used to remedy the problem. However, these materials are difficult to use, are very expensive and do not prevent blanket pullout, thereby limiting their use.

In the present invention, as the blanket force is substantially perpendicular the inner edge of the groove, there is essentially no tendency for the blanket to be pulled out the groove by the force. Therefore, conventional metals, such as steel or aluminum, may be used in thinner pieces and still achieve the desired effect. In addition, it has been found that in the present invention, the need for a bar that reinforces the blanket end is almost eliminated. Strips of plastic, or thermoset or rigid thermoplastic adhesives built up on one or both sides of the blanket provide all of the necessary reinforcement needed for the blanket in the present invention. This advantage eliminates the need for high strength, expensive alternatives and allows one to use any material of sufficient stiffness which is capable of being permanently attached to the blanket and is compatible with the blanket.

Table 1 shows the results of tests on reel rods having various angles between the inner edge of the groove and the adjacent surface of the reel rod and the effect upon blanket pullout.

The angles tested are from 112.6°, that of a conventional reel rod, to 85.6°, at succeeding increments of 2.3°.

The width of the longitudinal groove is varied, using three widths 0.225, 0.175 and 0.125 to show the effect on blanket pullout.

Likewise, the width of the blanket bar, (i.e. how far it extends up the blanket) is in two widths of 0.875 and 0.750 inches. The blanket bar is a 4 ply flexible graphite composite manufactured by A & M Engineering Composites Corp. of Marlboro, Mass., having a thickness of 0.022 inches, which is glued to one side of the blanket sample.

POLYWEB printing blankets, manufactured by W. R. Grace & Co., are used as the blanket samples in the tests.

The force, reflected in pounds, represents the amount of force required for a failure to occur. All samples are tested until such a failure happens. The failures are either caused by blanket pullout (represented by P in Table 1) or by blanket breakage, (represented by B in Table 1) wherein the blanket tensile strength is exceeded and the blanket rips rather than being pulled out of the axial groove.

TABLE 1

| θ (degrees) | Groove Width (inches) | Bar Width (inches) | Force (pounds) | Failure (B = Blanket Breakage) (P = Pullout) |
|---|---|---|---|---|
| | 0.225 | 0.875 | 78 | P |
| | 0.225 | 0.750 | 40 | P |
| 112.6 | 0.175 | 0.875 | 75 | P |
| | 0.175 | 0.750 | 70 | P |
| | 0.125 | 0.875 | 125 | P |
| | 0.125 | 0.750 | 115 | P |
| | 0.225 | 0.875 | 120 | P |
| | 0.225 | 0.750 | 60 | P |
| 110.3 | 0.175 | 0.875 | 120 | P |
| | 0.175 | 0.750 | 175 | P |
| | 0.125 | 0.875 | 135 | P |
| | 0.125 | 0.750 | 140 | P |
| | 0.225 | 0.875 | 155 | P |
| | 0.225 | 0.750 | 75 | P |
| 107.9 | 0.175 | 0.875 | 255 | B |
| | 0.175 | 0.750 | 117 | P |
| | 0.125 | 0.875 | 222 | P |
| | 0.125 | 0.750 | 140 | P |
| | 0.225 | 0.875 | 307 | P |
| | 0.225 | 0.750 | 183 | P |
| 105.6 | 0.175 | 0.875 | 200 | P |
| | 0.175 | 0.750 | 155 | P |
| | 0.125 | 0.875 | 250 | P |
| | 0.125 | 0.750 | 205 | B |
| | 0.225 | 0.875 | 280 | P |
| | 0.225 | 0.750 | 235 | P |
| 103.3 | 0.175 | 0.875 | 140 | P |
| | 0.175 | 0.750 | 270 | B |
| | 0.125 | 0.875 | 205 | P |
| | 0.125 | 0.750 | 220 | P |
| | 0.225 | 0.875 | 265 | B |
| | 0.225 | 0.750 | 175 | P |
| 101.1 | 0.175 | 0.875 | 135 | P |
| | 0.175 | 0.750 | 185 | P |
| | 0.125 | 0.875 | 245 | B |
| | 0.125 | 0.750 | 250 | B |
| | 0.225 | 0.875 | 270 | P |
| | 0.225 | 0.750 | 170 | P |
| 98.8 | 0.175 | 0.875 | 247 | P |
| | 0.175 | 0.750 | 157 | P |
| | 0.125 | 0.875 | 250 | B |
| | 0.125 | 0.750 | 245 | P |
| | 0.225 | 0.875 | 265 | B |
| | 0.225 | 0.750 | 250 | B |
| 96.6 | 0.175 | 0.875 | 230 | B |
| | 0.175 | 0.750 | 240 | B |
| | 0.125 | 0.875 | 260 | B |
| | 0.125 | 0.750 | 255 | B |

TABLE 1-continued

| θ (degrees) | Groove Width (inches) | Bar Width (inches) | Force (pounds) | Failure (B = Blanket Breakage) (P = Pullout) |
|---|---|---|---|---|
| | 0.225 | 0.875 | 260 | B |
| | 0.225 | 0.750 | 238 | B |
| 94.4 | 0.175 | 0.875 | 273 | B |
| | 0.175 | 0.750 | 255 | B |
| | 0.125 | 0.875 | 250 | B |
| | 0.125 | 0.750 | 260 | B |
| | 0.225 | 0.875 | 233 | B |
| | 0.225 | 0.750 | 247 | B |
| 92.2 | 0.175 | 0.875 | 253 | B |
| | 0.175 | 0.750 | 255 | B |
| | 0.125 | 0.875 | 245 | B |
| | 0.125 | 0.750 | 255 | B |
| | 0.225 | 0.875 | 255 | B |
| | 0.225 | 0.750 | 268 | B |
| 90.0 | 0.175 | 0.875 | 247 | B |
| | 0.175 | 0.750 | 257 | B |
| | 0.125 | 0.875 | 248 | B |
| | 0.125 | 0.750 | 252 | B |
| | 0.225 | 0.875 | 270 | B |
| | 0.225 | 0.750 | 249 | B |
| 87.8 | 0.175 | 0.875 | 258 | B |
| | 0.175 | 0.750 | 274 | B |
| | 0.125 | 0.875 | 250 | B |
| | 0.125 | 0.750 | 269 | B |
| | 0.225 | 0.875 | 290 | B |
| | 0.225 | 0.750 | 260 | B |
| 85.6 | 0.175 | 0.875 | 271 | B |
| | 0.175 | 0.750 | 257 | B |
| | 0.175 | 0.875 | 300 | B |
| | 0.125 | 0.750 | 284 | B |

It is clear from Table 1 that variations in groove width and bar length have little or no effect upon blanket pullout. The results clearly demonstrate that the angle at which the blanket exits the groove of the reel rod and meets the adjacent surface, controls whether blanket pullout will occur. This is dramatically shown in that at all angles below about 97°, the failures are all caused by blanket failure, not pullout.

Even more dramatic is the comparison between the conventional reel rod having an angle of greater than 112° and a preferred embodiment of the present invention having the angle at 90°. In the conventional reel rod, all samples fail from blanket pull at very low applications of force, while in the preferred embodiment of 90°, all of the samples fail from blanket breakage at levels of force three to six times greater than those imposed on the corresponding conventional reel rod.

The present invention represents a significant improvement in the printing industry, eliminating one of the problems which has prevented the large scale development and use of narrow gap type cylinders and bars.

Most of the discussion of the present invention has been directed to its use in the narrow gap printing area. However, it is not the intention of the applicant to so limit its use. The present invention is useful on conventional printing cylinders as well as narrow gap cylinders.

While this invention has been described with reference to its preferred embodiment in the printing industry, other embodiments of the present invention can be used in other industries where the need for fast and secure retention of sheet material is desired. In particular, the present invention is useful in any application which requires or desires the secure attachment of sheet materials to a cylinder.

While this invention has been described with reference to its preferred embodiments, other embodiments can achieve the same result. Variations and modifications of the present invention will be obvious to those skilled in the art and it is intended to cover in the appended claims all such modifications and equivalents as fall within the true spirit and scope of this invention.

What I claim is:

1. A reel rod comprising a rotatable spindle having an axial groove into which an end or ends of a printing blanket are inserted, and a substantially planar surface extending from an inner edge of the axial groove and crossing over the center of said spindle to an edge of the reel rod substantially perpendicular to the inner edge so that a portion of the blanket adjacent the blanket ends meets and conforms to the substantially planar surface.

2. A reel rod of claim 1 wherein the angle formed between the substantially planar surface and the groove edge is from about 85° to 97°.

3. A reel rod of claim 1 wherein the angle formed between the substantially planar surface and the groove edge is about 90°.

4. A reel rod comprising a rotatable spindle having an axial groove formed radially inwardly in the reel rod for receiving an end of a blanket therein, the axial groove having an inner edge located adjacent the diameter of the reel rod and an outer edge located farther away from the diameter of the reel rod and closer to a first outer surface of the reel rod than the inner edge, the reel rod having a substantially planar surface extending from the inner edge of the axial groove to a second surface beyond the center of the diameter of the reel rod and opposite the first outer surface, and the substantially planar surface forming an angle of from about 85° to 97° with an inner edge of the axial groove so that a blanket end portion inserted into the axial groove and extending across the substantially planar surface is prevented from slipping out of the groove.

5. The reel rod of claim 4 wherein the substantially planar surface forms a 90° angle with the inner edge of the axial groove.

6. The reel rod of claim 4 wherein the axial groove is located off center of the diameter of the reel rod.

7. A reel rod for securing a printing blanket to a printing cylinder comprising a rotatable spindle having an axial groove being offset and parallel to a diameter of the reel rod, the axial groove having an inner edge and an outer edge, the inner edge being located closer to the diameter of the reel rod than the outer edge, the outer edge being located closer to a first outer surface of the reel rod located on the same side of the center of the diameter as the axial groove, the surface of the reel rod containing the axial groove being substantially flattened from the inner edge of the axial groove to a second outer surface located beyond the diameter of the reel rod so as to form a flattened surface between the inner edge of the axial groove and the second outer surface wherein the flattened surface is substantially perpendicular to the inner edge of the axial groove and the flattened surface and the inner edge of the axial groove form an angle such that a blanket force F′ is parallel to the flattened surface and substantially perpendicular to the inner edge of the groove.

8. The reel rod of claim 7 wherein the flattened surface forms an angle of about 85° to 97° with the inner edge of the axial groove.

9. The reel rod of claim 7 wherein the flattened surface forms an angle of about 90° with the inner edge of the axial groove.

* * * * *